United States Patent [19]

Deutsch et al.

[11] 4,368,658

[45] Jan. 18, 1983

[54] APPARATUS FOR SOLO HARMONY TRANSFER IN AN ELECTRONIC MUSICAL INSTRUMENT

[75] Inventors: Ralph Deutsch, Sherman Oaks; Leslie J. Deutsch, Glendale, both of Calif.

[73] Assignee: Kawai Musical Instrument Mfg. Co., Ltd., Hamamatsu, Japan

[21] Appl. No.: 237,009

[22] Filed: Feb. 24, 1981

[51] Int. Cl.[3] ..... G10F 1/00

[52] U.S. Cl. ..... 84/1.03; 84/1.17; 84/DIG. 22

[58] Field of Search ..... 84/1.03, 1.01, DIG. 22, 84/1.17, 1.24

[56] References Cited

U.S. PATENT DOCUMENTS

| | | | |
|---|---|---|---|
| 4,112,802 | 9/1978 | Robinson et al. | 84/DIG. 22 |
| 4,120,225 | 10/1978 | Dietrich et al. | 84/DIG. 22 |
| 4,187,756 | 2/1980 | Robinson et al. | 84/DIG. 22 |
| 4,267,762 | 5/1981 | Aoki et al. | 84/DIG. 22 |
| 4,296,665 | 10/1981 | Howell | 84/1.03 |

*Primary Examiner*—J. V. Truhe
*Assistant Examiner*—Forester W. Isen
*Attorney, Agent, or Firm*—Ralph Deutsch

[57] ABSTRACT

In an electronic musical instrument having a first and second array of keyboard switches apparatus is provided for providing fill-in notes sounded by tone generators assigned to the first keyboard. The fill-in notes are selected by selecting one of a library of stored chord types which is closest to the notes played on the second keyboard combined with the highest frequency note played on the first keyboard. The closest decision is made by processing the keyed switch data with two sets of matched filters. The chord type decision is made to correspond to a matched filter combination which produces a maximum output response. A root note is also chosen for the selected chord type. The selected chord type and chosen root note are used to provide the fill-in notes.

19 Claims, 7 Drawing Figures

APPARATUS FOR SOLO HARMONY TRANSFER IN AN ELECTRONIC MUSICAL INSTRUMENT

BACKGROUND OF THE INVENTION

1. Field of the Invention

This invention relates broadly in the field of electronic musical tone generators and in particular is concerned with provision for transferring notes played on an accompaniment keyboard to add to notes played on a solo keyboard.

2. Description of the Prior Art

Electronic musical designers have exploited the mechanical-like tone production implementation of keyboard instruments to provide a variety of ancillary systems to aid the neophyte musician. These ancillary systems have a common object of enabling the new musician to generate tonal effects which usually can only be performed when one has attained a practised dexterity on the keyboard. Such ancillary systems include those of automatic arpeggios, chords controlled in preselected rhythmic patterns, automatic pedal accompaniment played in rhythmic patterns, automatic glissandos, and automatic portamento frequency transitions.

A new keyboard instrument player quickly discovers a satisfaction in playing a simple monophonic solo line on a solo keyboard which is supported by chords played with the left hand on an accompaniment keyboard. Accomplished keyboard instrument players using an organ will augment the solo line of a musical piece by adding notes to an otherwise monophonic solo part. This is usually accomplished by inserting notes on the solo keyboard corresponding to notes belonging to the chords that are played on the accompaniment keyboard. The notes added to the solo part, often referred to as "fill-ins", are usually not scored in the written music. These are provided by the player in an ad lib fashion. The proper selection of fill-in notes requires a musical sophistication on the part of the player that is beyond the capability of the beginning player. It is all too easy to produce objectionable dissonant musical effects by attempting to add fill-in notes to a solo musical line.

Several systems have been developed which add fill-in notes to a keyboard by transferring notes played on an accompaniment keyboard. Such a system is disclosed in U.S. Pat. No. 3,823,246 entitled "Chord Playing Organ Including A Circuit Arrangement For Adding Fill-In Notes To The Solo Part." The patent describes apparatus that in the fill-in mode of operation utilizes the lower, or accompaniment, keyboard of an organ as a monophonic chord input data set of keys. In this mode a single finger is used to actuate a keyboard switch and thereby select a predetermined chord type. The selected chord is sounded for the set of stops, or tone switches, actuated for the accompaniment keyboard. Two notes of the automatically generated chord are transferred to the solo keyboard and the transferred notes are played at the same time that a note is actuated on the solo keyboard. The transferred notes are caused to sound in an octave below the actuated solo note. The two transferred notes are selected from the automatically generated chord by using a selection logic that is responsive to the actuated solo note. In this fashion dissonant harmonic intervals can usually be eliminated. Circuitry is provided to inhibit the chord generating apparatus if more than one note is actuated on the lower keyboard.

An improvement to the system disclosed in U.S. Pat. No. 3,823,246 is contained in U.S. Pat. No. 3,990,339 entitled "Electronic Organ And Method Of Operation." The musical effect produced by the disclosed system is very similar to that previously described for U.S. Pat. No. 3,823,246. A time delay is incorporated so that the fill-in notes are automatically inhibited during the execution of a sequence of "fast" notes played on the solo keyboard.

The present invention provides a novel means for providing fill-in notes for a solo melodic line and incorporates a feature that selects the fill-in notes using data produced by the actuated upper and lower keyboard switches. Both keyboards can be operated in their normal polyphonic mode. The invention includes means for correcting some accidental mistakes such as when almost completely nonsensical combinations of notes are actuated.

SUMMARY OF THE INVENTION

The present invention is directed to a novel and improved arrangement for automatically providing fill-in notes transferred from data produced by actuated keyswitches on an accompaniment keyboard in response to actuated keyswitches on a solo keyboard. The fill-in notes produce musical tones corresponding to selected tones on the solo keyboard. An important feature is an arrangement for automatically selecting a chord type that is closest to chord type belonging to a preselected library of chord types. This selection is accomplished by implementing a selection logic that is responsive to the actuated keyswitches on both the solo and accompaniment keyboards. The "closest" criterion is implemented in a matched filter sense of maximum correlation using a set of stored reference chord information which comprises the library of chord types. At the same time that the chord selection is made the corresponding root note for the selected chord is also selected.

The chord detection means employs a multiplicity of matched filters. It is known in the signal art theory that a matched filter will provide as an output signal, in the presence of a noisy input signal, one that has a maximum signal to noise power ratio. Moreover, it is known that the matched filter's impulse response must be the reversed image of the signal. A discussion of these properties can be found starting on page 163 of the book:

Ralph Deutsch, *System Analysis Techniques.* Englewood Cliffs, N.J., Prentice-Hall, Inc., 1969.

In cases for which the selection logic finds a plurality of equal closeness measures, the final selection is made using a programmed priority rating which selects a more commonly used musical chord type over a less commonly used chord type.

It is an objective of the present invention to provide means for providing solo harmony fill-in notes by a selection logic which uses data from all the actuated keyboard switches.

Another objective of the present invention is to provide fill-in notes that reduce the probability of producing musical dissonances even if errors are made by the musician

BRIEF DESCRIPTION OF THE DRAWINGS

For a better understanding of the invention reference should be made to the accompanying drawings.

DETAILED DESCRIPTION OF THE INVENTION

Figure 1:
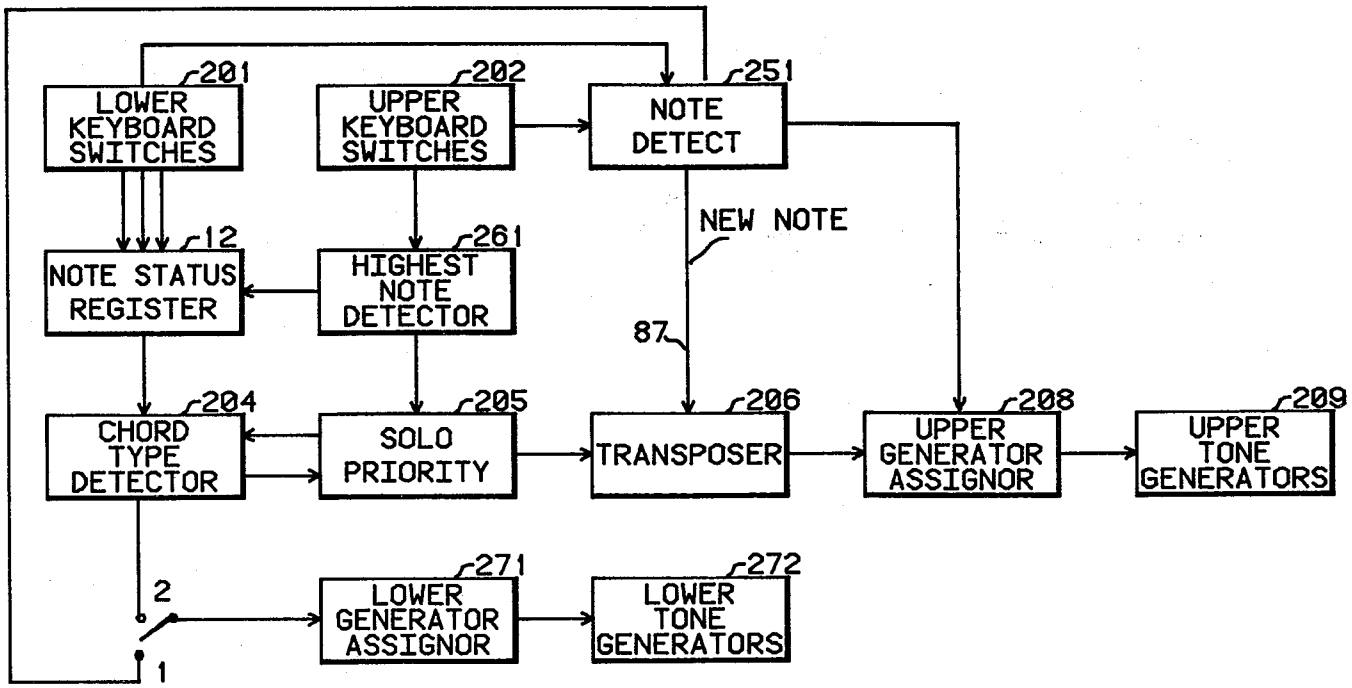
FIG. 1 is a schematic block diagram of an embodiment of the present invention.

FIG. 1 shows an embodiment of the present invention for providing fill-in solo harmony notes selected from data provided from actuated keyswitches on both the upper and lower keyboard switches of an electronic keyboard musical instrument. The actuated keyswitches for the array of keyswitches contained in the lower keyboard switches 201 cause a logic "1" state to be transferred to the note status register 12. The note status register 12 contains a binary word in which the "1" states correspond to an actuated keyswitch, or a musical note, on the lower keyboard in addition to the data provided by the highest note detector 261.

Figure 2:
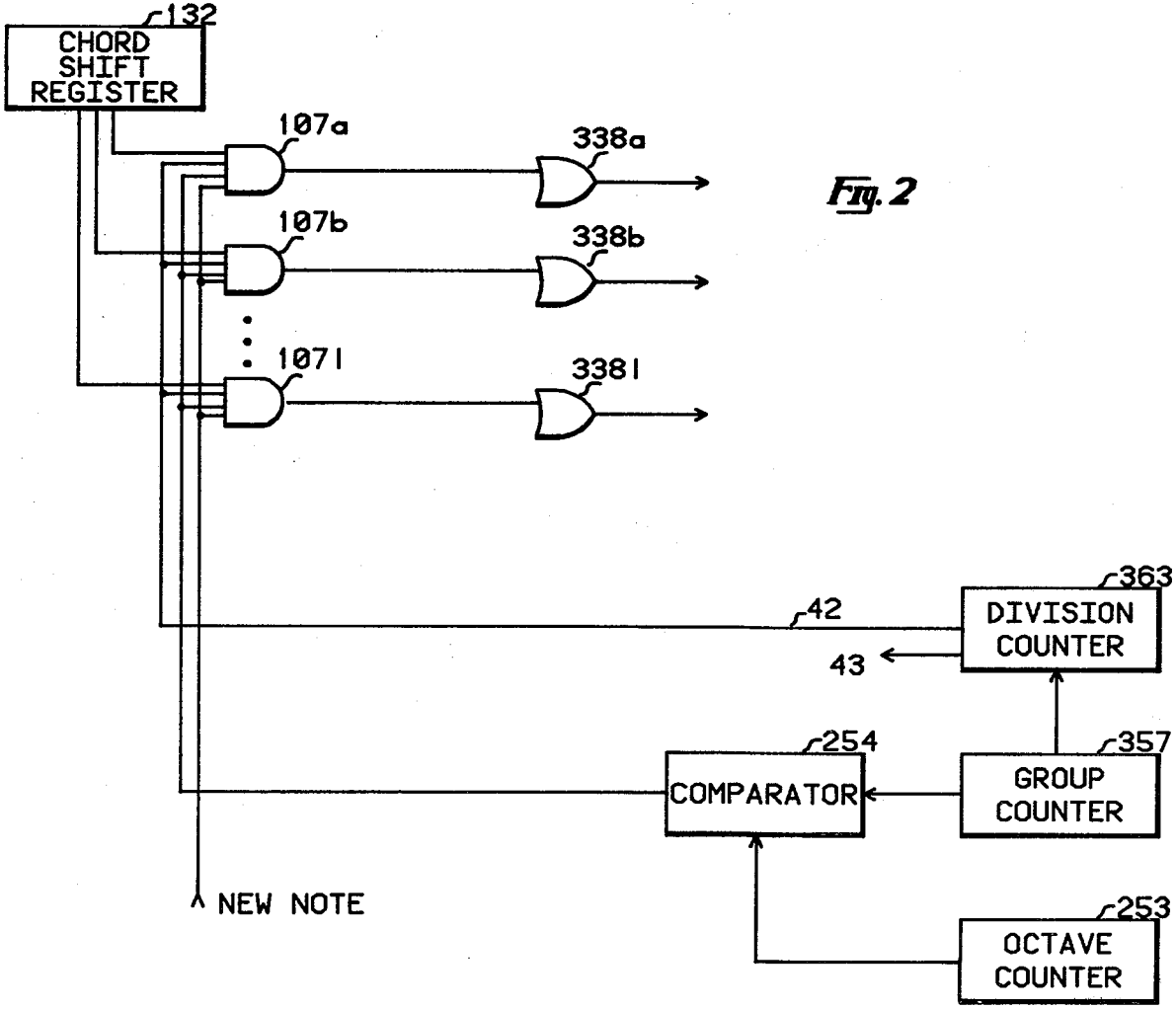
FIG. 2 is a schematic diagram of the keyboard switches.

Both the upper and lower keyswitches contain two sets of contacts. The first set of contacts corresponds to the normal mode of operation in which each keyswitch corresponds to a given musical frequency in the frequency range of the keyboard. The second set of contacts are used in the fill-in mode. These contacts are connected in "parallel octaves." That is, for example, the keyswitch outputs of $C_2$, $C_3$, $C_4$, $C_5$, $C_6$, and $C_7$ are summed so that the keyswitches act in parallel. The same summing arrangement is used for all the other notes in the musical octave. In this fashion, chord information in a single octave can be obtained by actuating a set of keyswitches in any position on the keyboards. FIG. 2 illustrates the connection of keyswitches in parallel octaves. The particular octave in which the keyswitches are actuated has no effect on the input keyswitch status information presented to the note status register 12.

Figure 3:
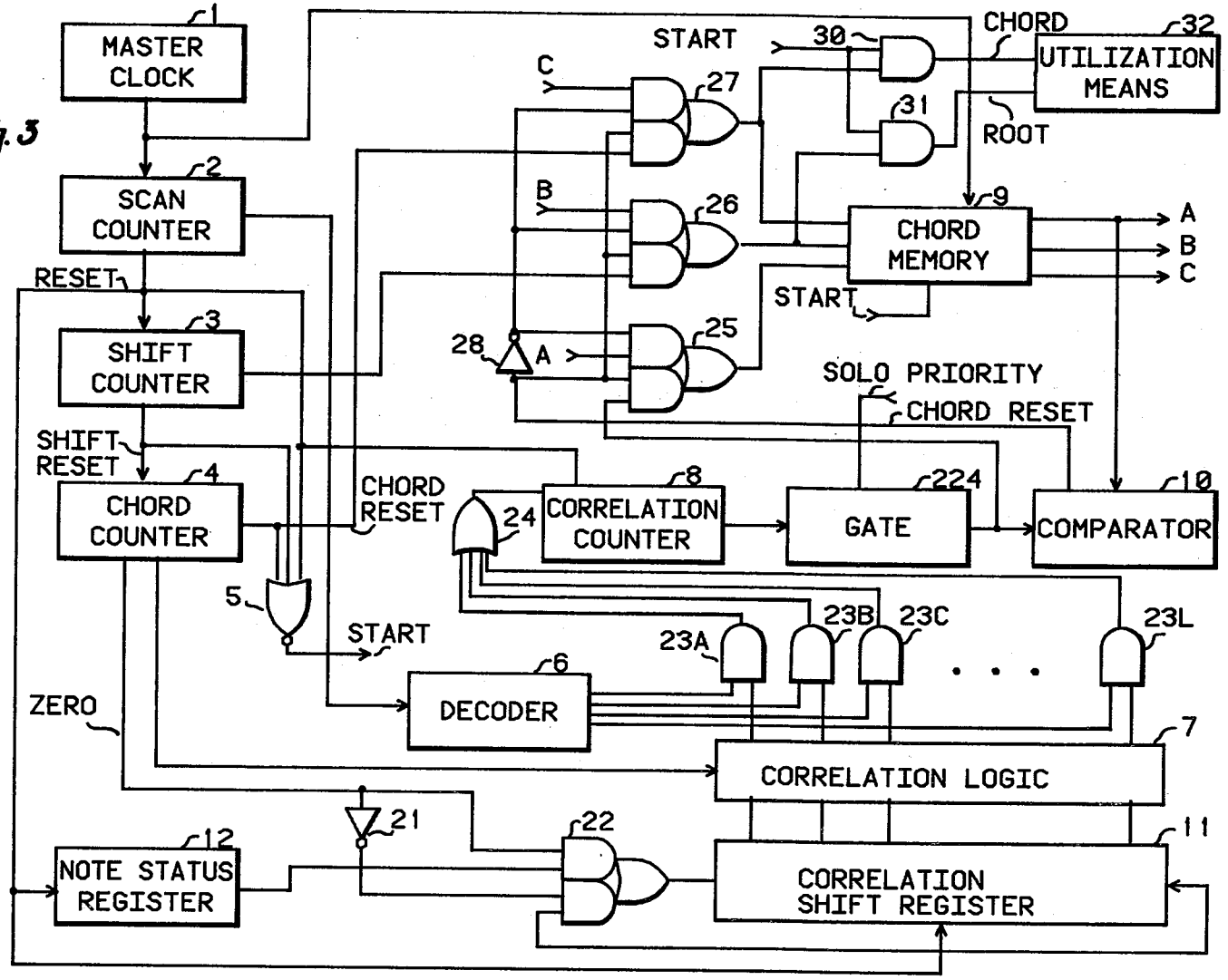
FIG. 3 is a schematic diagram of the chord type and root note detector.

The chord type detector 204 selects a chord type from a library of preselected chord types using the actuated keyswitch data contained in the note status register 12. The selection is based upon a closeness criterion and a priority logic. The details of the chord type detector 204 are shown in FIG. 3 and described below.

Figure 4:
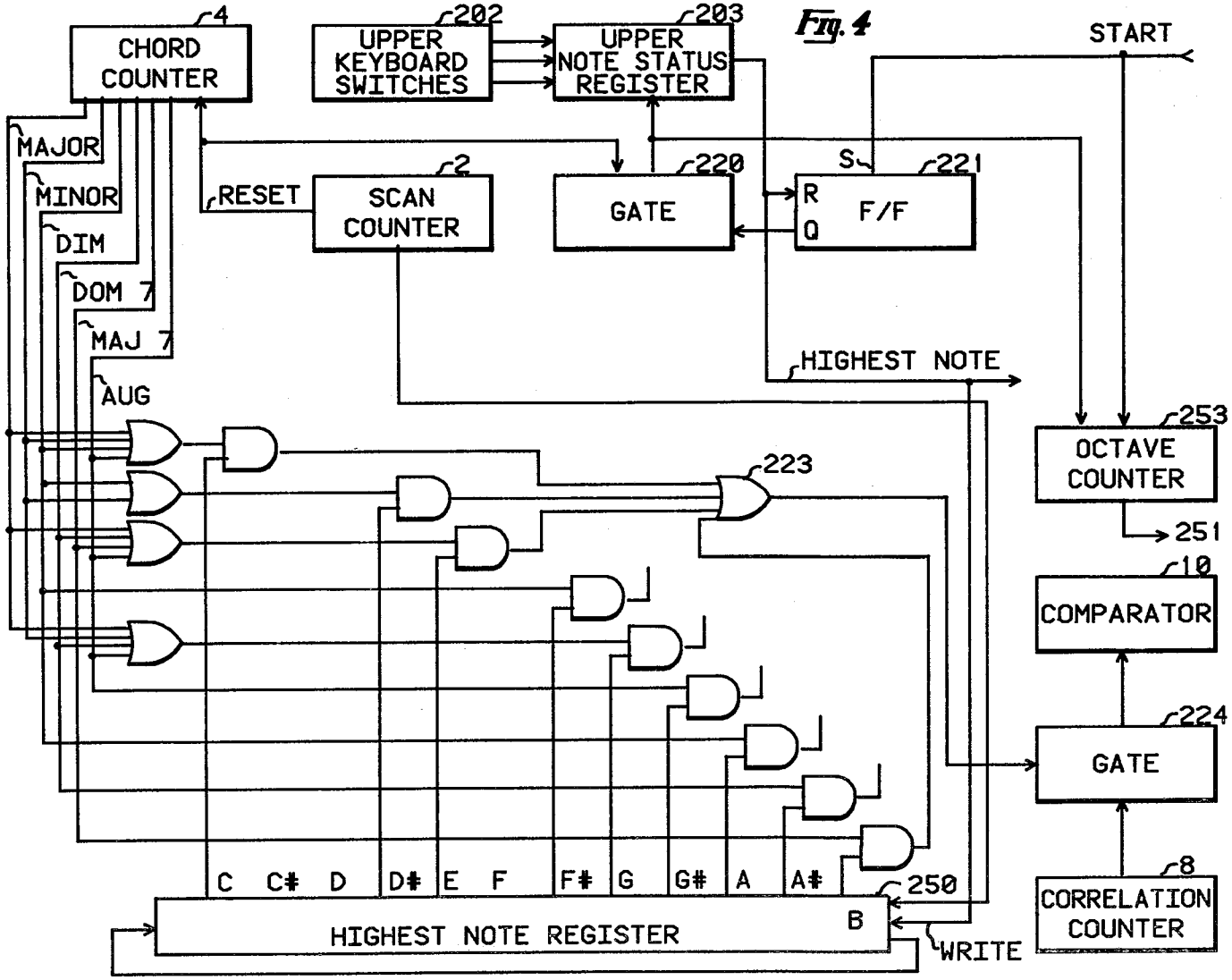
FIG. 4 is a schematic diagram of the solo priority subsystem.

The solo priority 205 operates to force the chord type detector 204 to only select chords which have the highest note played on the upper keyboard switches 202 as one of the selected chord notes. The detailed logic of the solo priority 205 is shown in FIG. 3 and FIG. 4 and described below.

The transposer 206 uses the selected chord type and root note data to furnish data in a format which is used by the upper generator assignor 203 to assign selected members of the upper tone generators 209 so that the selected chord acts as a fill-in to the notes actuated on the upper keyboard switches 202.

The lower generator assignor 271 is used to select a subset of the multiplicity of tone generators contained in the system block labeled lower tone generators 272. A selector switch is used on the input data lines to the lower generator assignor 271 so that one of the two operating modes can be chosen by the musician. The first mode, when selected by the switch in position 1, assigns the lower tone generators to the actuated keyswitches contained in the lower keyboard switches 201. The second mode, when selected by the switch in position 2, assigns the lower tone generators to the chord notes selected by the chord type detector 204. In the second operational mode, errors in the form of an incorrectly keyed chord are eliminated by the substitution of a selected member of a library of chord types for the actual key notes in the lower keyboard switches 201.

The operation of the chord type detector 204 is similar to the system described in the copending patent application Ser. No. 75,432 entitled "Automatic Chord Type And Root Note Detector" now U.S. Pat. No. 4,282,786. The referenced application has the same inventors as the present invention and both are assigned to the same assignee.

The detailed logic of the chord type detector 24 is shown in FIG. 3. The chord input data consists of the keyswitch actuations for the lower keyboard switches 201 and the highest note actuated on the upper keyboard switches 202. These are stored in the note status memory 12. The highest actuated note on the upper keyboard switches 202 is detected by the highest note detector 261. The note status register 12 is advantageously implemented as a parallel loaded 12 bit shift register. Each bit location in this shift register corresponds to a note within a musical octave. The assignment of an actuated switch signal to a bit position within the note status memory is equivalent to assigning a note number to this signal. This is called a note number signal.

The timing of the logic functions shown in FIG. 3 is controlled by the master clock 1. The entire chord and root note detection process requires $7\times12\times12=1008$ master clock timing pulses. For a master clock rate of 1 Mhz. the detection process requires a time of about one millisecond. This time is short enough to be considered essentially instantaneous for a musical instrument.

Scan counter 2 is a counter which is incremented by the master clock 1 and counts modulo 12. A RESET signal is generated by the scan counter 2 each time it resets itself to its initial state because of its modulo counting implementation. The initial state of a counter in this description is defined as the minimal value of its permissible count states.

Shift counter 3 is a counter which is incremented by the RESET signals generated by the scan counter 2. Shift counter 3 counts modulo 12 and generates a SHIFT RESET signal each time the counter resets itself to its initial state because of its modulo counting implementation.

Chord counter 4 is a counter which is incremented by the SHIFT RESET signals generated by the shift counter 3. Chord counter 4 counts modulo 7 and generates a CHORD RESET signal each time the counter resets itself to its initial state because of its modulo counting implementation.

When the count states of the scan counter 2, the shift counter 3, and the chord counter 4 have all been simultaneously incremented to their initial state, the NOR-gate 5 will generate a START signal in response to a simultaneous logic "1" state for the RESET, SHIFT RESET, and CHORD RESET signals. The START signal initializes the process of determining the closest chord type and root note for the actuated keyswitch status data stored in the note status register 12.

Chord memory 9 is a register whose contents are initialized to zero values in response to the START signal created by the NOR-gate 5. Chord memory 9 is divided into three associated subregisters which are called segments. The segment 1 subregister is used to store the highest value of a correlation number obtained in a manner to be described. The segment 2 subregister is used to store the chord type number corresponding to the value of the correlation number stored in the segment 1 subregister. The segment 3 subregister is used to store the root note number, or chord root number, of the chord corresponding to the chord type number stored in the segment 2 subregister.

The count state of chord counter 4 is used to determine the chord type that is used by the system to examine the chord input data stored in the note status register 12. Table 1 lists the chord types corresponding to each state of the chord counter.

TABLE 1

| Count State | Chord Type |
|---|---|
| 0 | Major |
| 1 | Major |
| 2 | Minor |
| 3 | Dominant 7th |
| 4 | Diminished |
| 5 | Augmented |
| 6 | Major 7th |

Data is addressed out of the note status register 12 in response to the RESET signals created by the scan counter 2. This addressed data is transferred to the correlation shift register 11 only during the time interval during which chord counter 4 is in its zero state. For the remainder of the 7 states of the chord counter 4, the data previously loaded into the correlation shift register 11 during the zero state is shifted in the conventional end-around mode for a shift register used as a data memory. The end-around data circulation is controlled by the inverter 21 in combination with the data select gate 22. The correlation shift register 11 contains 12 bits; each corresponding to a note of the musical scale. An output data point is provided for each bit position of the correlation shift register.

The count states of the chord counter 4 are used to select the operating status of the correlation logic 7. The correlation logic 7 comprises circuitry which acts as a set of matched filters for each of the chord types listed in Table 1. The correlation logic action is listed in Table 2. For each of the count states of the chord counter 4, Table 2 indicates whether or not an output from one of the output terminals of the correlation shift register 11 is to be used as is, or if it will be inverted. A "1" entry in Table 2 indicates the condition for no bit inversion. The 12 data output terminals in Table 2 for the correlation shift register are labeled, for convenience, as musical notes. The first bit shifted out of the note status register 12 corresponds to the musical note B.

TABLE 2

| | Correlation Shift Register Output | | | | | | | | | | | |
|---|---|---|---|---|---|---|---|---|---|---|---|---|
| Chord Counter State | C | C# | D | D# | E | F | F# | G | G# | A | A# | B |
| 0 | 1 | 0 | 0 | 0 | 1 | 0 | 0 | 1 | 0 | 0 | 0 | 0 |
| 1 | 1 | 0 | 0 | 0 | 1 | 0 | 0 | 1 | 0 | 0 | 0 | 0 |
| 2 | 1 | 0 | 0 | 1 | 0 | 0 | 0 | 1 | 0 | 0 | 0 | 0 |
| 3 | 1 | 0 | 0 | 0 | 1 | 0 | 0 | 1 | 0 | 0 | 1 | 0 |
| 4 | 1 | 0 | 0 | 1 | 0 | 0 | 1 | 0 | 0 | 1 | 0 | 0 |
| 5 | 1 | 0 | 0 | 0 | 1 | 0 | 0 | 0 | 1 | 0 | 0 | 0 |
| 6 | 1 | 0 | 0 | 0 | 1 | 0 | 0 | 1 | 0 | 0 | 0 | 1 |

The library of chord types listed in Table 1 is used for illustrative purposes and does not represent a limitation of the present invention. Additional or substitute chord types may be used in a manner which is evident from the following system logic description. The particular list of chord types listed in Table 1 was chosen because these are the chord types that are most frequently used by keyboard instrument musicians.

It is noted that Table 1 lists two chord counter states for a major chord. As described below, the use of dual chord states is to accomodate the situation in which only data corresponding to a single actuated keyswitch is contained in the note status register 12. It is semantically convenient to consider even a single note as a chord by using a generic meaning of the term "chord" to include the situation in which one or more notes are played simultaneously. A single note chord is designated by default to be a major chord. The system can be readily implemented to use another chord type for the default of a one note chord, if such an alternative is desired.

When the START signal is created by the NOR-gate 5, chord counter 4 will be in its initial, or zero, count state. In response to the zero state signal from chord counter 4, the select gate 22 will transfer data read serially from note status register 12 to the correlation shift register 11.

Figure 5:
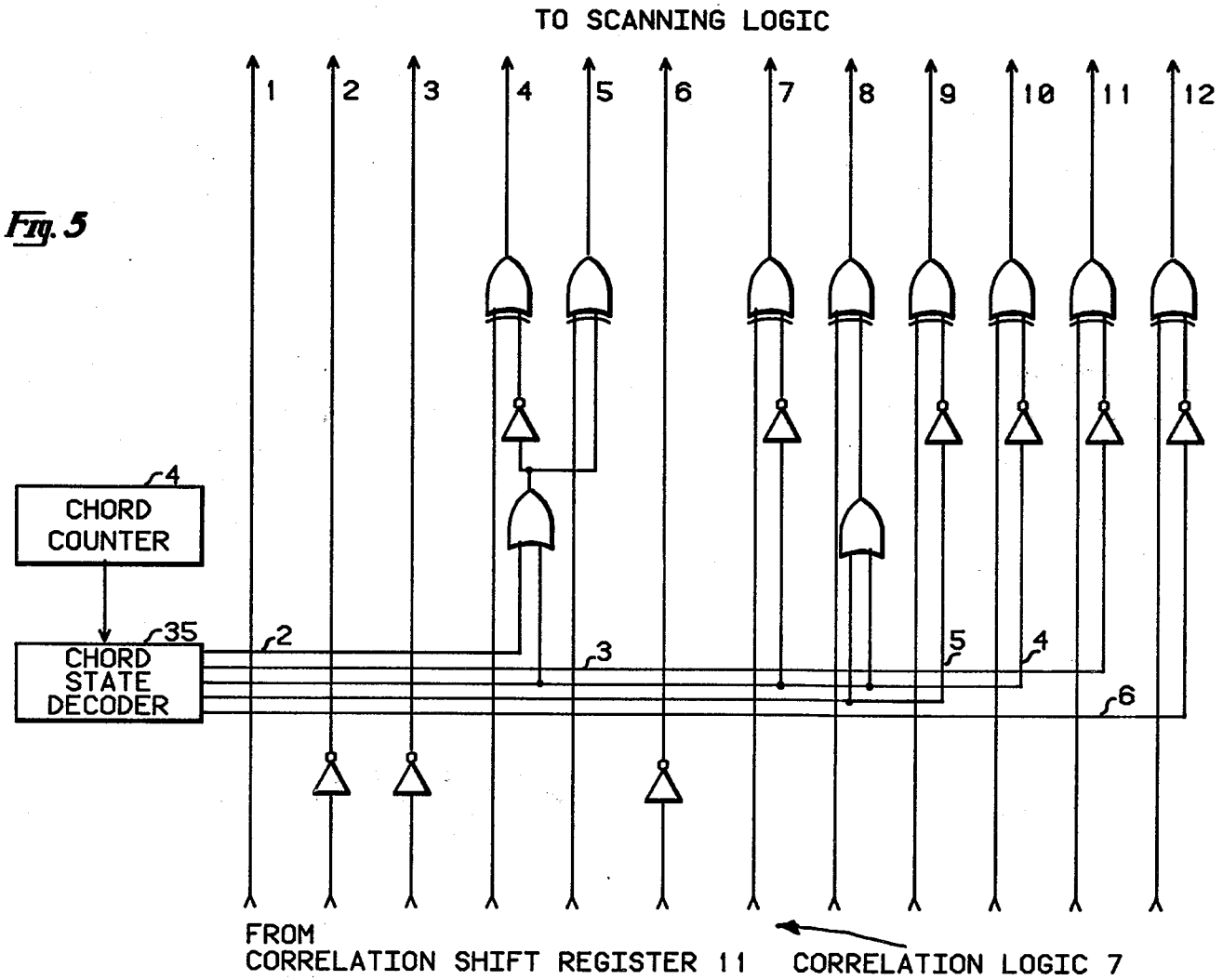
FIG. 5 is a schematic diagram of the correlation logic.

The details of the correlation logic 7 which implements the logic listed in Table 2 is shown in FIG. 5. Since the output of the first position (note C in Table 2) is always a logic state "1", this transfer condition can be hardwired for all of the chord types listed in Table 1. A similar constancy for a "0" logic state exists for the output terminals positions 2, 3, and 6. These positions accomodate all chord types by using a fixed bit invertor as shown in FIG. 5.

The correlation scanning logic, shown in FIG. 3, consists of the combination of the decoder 6, and a set of 12 AND-gates labled 23A through 23L, and the OR-gate 24.

Each time that the scan counter 2 is reset because of its modulo counting action, a RESET signal is generated which is used to advance the data being read out of the note status register 12. The same RESET is also used to advance the data stored in the correlation shift register 11. Thus there are 12 clock intervals from the master clock 1 assigned to each programmed state of the logic in the correlation logic 7. For each count state of the scan counter 2, decoder 6 decodes the binary coded state of the scan counter to one of the 12 output signal lines. These 12 output signal lines in conjunction with the set of 12 AND-gates 23A to 23L cause the output data lines from the correlation logic 7 to be scanned sequentially. The scanned data is transmitted to the OR-gate 24.

Each time that an output signal from the correlation logic 7 is scanned by the decoder 6 and one of the set of AND-gates 23A to 23L and is found to be in a "1" logic state, the OR-gate 24 transfers the "1" state. The output from the OR-gate 24 is used to increment the correlation counter 8.

The correlation counter 8 is incremented by the signals received from the OR-gate 24. This counter is implemented to count modulo 12. The number 12 is equal to the maximum number of "1" logic state signals that can be received by scanning the output signals from the correlation logic 7 for any given state of the chord counter 4.

The correlation counter 8 is placed in its initial state by the RESET signal generated each time that the scan counter 2 is reset because of its modulo 12 counting implementation.

In the fashion described the state of the correlation counter 8 at the end of any scan cycle of 12 counts of scan counter 2, will be the cross-correlation number of the input data contained in the note status register 12 and the current chord type associated with the state of the chord counter 4. Moreover, the root note, or chord root number, of the chord associated with this cross-correlation number will be the count state of shift counter 3. It is customary to call the cross-correlation number by the abbreviated term of "correlation number" when no ambiguity arises of whether the correlation is between two different signals or with one signal and a replica of itself.

As described above, when the scan counter 2 resets itself because of its modulo counting implementation the correlation counter 8 is reset thereby enabling it to start a new correlation count. If the highest note actuated on the upper keyboard switches is a member of the current chord and root note combination of the correlation shift register 11 and correlation logic 7, then the count state of the correlation counter 8 is transferred by gate 224 to act as one input to the comparator 10. If these conditions are not true, then gate 224 will transfer a zero value to the comparator 224. The logic used to control gate 224 is shown in FIG. 4 and described later.

The comparator 10 compares the highest value of the previously detected correlation numbers contained in segment 1 of the chord memory 9 with the current count state of the correlation counter 8 as transferred by gate 224. If it is found that the correlation number from gate 224 is greater than the current maximum value stored in segment 1 of the chord memory 9, the new maximum value is then stored in this memory segment.

The output line A from the chord memory 9 corresponds to the stored correlation numbers in segment 1. Since the correlation number has a maximum value of 12, the segment 1 memory is implemented to store a 4 bit binary word. The output line A represents a set of 4 lines. For drawing simplicity only one such line is shown in FIG. 4 which represents the entire set of bit lines. In the same fashion, the single lines from the correlation count 8 to the gate 224, and from this gate to the comparator 10 represent a corresponding set of 4 signal lines for the 4 bit binary words.

The data select gate 25 is one of a set of 4 identical select gates. Each one of these data select gates is associated with one of the 4 lines containing the current count state of the correlation counter 8.

If the comparator 10 finds that the current correlation value transferred by gate 224 is less than or equal to the current value stored in segment 1 of the chord memory 9, a "0" logic state signal is placed on line 29 by the comparator 10. In response to a "0" signal on line 29 and the signal inversion action of the invertor 28, the data select 25 will cause the data on line A to be rewritten into segment 1 of the chord memory 9.

If the comparator finds that the current correlation value transferred by gate 24 is greater than the current value stored in segment 1 of the chord memory 9, a "1" logic state signal is placed on line 29 by the comparator 10. In response to a "1" signal on line 29, the data select 25 will transfer the correlation number output of gate 224 to be stored in segment 1 of the chord memory 9.

The signal output line B, shown in FIG. 3, represents a set of 4 lines containing the 4 bits for the binary data word stored in segment 2 of the chord memory 9. These 4 bits represent one of the 12 notes in a musical octave. Similarly the data select gate 26 represents one of a set of 4 identical select gates corresponding to each of the 4 bits used to designate a note in the musical octave.

If a "0" signal is present on line 29, the current stored root note number found on line B is transferred by the select gate 26 to be rewritten in segment 2 of the chord memory 9. If a "1" signal is present on line 29, the current state of the shift counter 3 is transferred by data select gate 26 to be written in segment 2 of the chord memory 9. This new value corresponds to the root note for a new detected maximum value of the correlation counter 8.

The signal output line C from the chord memory 9 represents a set of 3 lines containing the three bits of a binary data word stored in segment 3 of the chord memory 9. These 3 bits are used to designate one of the 7 chord types of the library of chord types which is listed in Table 1. Similarly the data select gate 27 represents one of a set of 3 identical select gates corresponding to each of the 3 bits on line C.

If a "0" signal is present on line 29, then the current stored chord type number found on line C is transferred by the select gate 27 to be rewritten in segment 3 of the chord memory 9. If a "1" signal is present on line 29, the current state of the chord counter 4 is transferred by the data select gate 27 to be written in segment 3 of the chord memory 9. This new value corresponds to the chord type for a new detected maximum value of the correlation counter 8.

It should be noted that the comparison logic described above provides a desirable detection priority for the library of chord types. The priority order is that listed in Table 1 with a major chord having the highest priority. The listed chord priorities correspond with the usual frequency of usage for this set of chords in playing popular music. In the preferred embodiment of the present invention, a major chord is given the greatest priority and a major 7th chord is given the least priority. In the described embodiment of the invention if two or more chord types yield identical correlation values, the decision is automatically made to select the chord type having the highest priority.

The preferred embodiment also automatically encompasses the situation in which nonsensical information is presented to the detection system by actuating a set of keyboard switches that does not correspond to any of the implemented library of chord types or, in fact, does not correspond to any musical chord. For example, the input data might consist of 2 to 5 consecutive notes in a musical octave. For such "nonsense" data input, the detection system will still select a chord type and root note. The selection, as in all other cases, is based upon a "closest" measure to a member of the available library of chord types. "Closest" is measured as that chord type which produces the largest value of the correlation number and wherein the existence of a plurality of equal values is resolved by the above described chord type priority decision implementation.

At the end of a complete correlation calculation encompassing the library of 7 chord types, the best available chord type and root note decision is available from the set of AND gates 30 and 31. AND-gate 31 represents one of a set of three identical AND-gates and AND-gate 31 represents one of a set of four identical AND-gates.

The chord type and root note information available at the end of each complete detection cycle is transferred to the utilization means 32. The utilization means contains the transposer 206, upper generator assignor 208, upper tone generators 209, lower generator assignor 271, and lower tone generators 272.

The chord type decisions made by the system shown in FIG. 3 are summarized in the following list.

One note chord (i) system will select a major chord with the detected note chosen as the root note.

Two note chords (i) minor 2nd: selects major chord with the higher note chosen as the root note.

(ii) major 2nd: selects major chord with the higher note chosen as the root note.

(iii) minor 3rd: selects major chord with the root note a major 3rd below the lower note (iv) major 3rd: selects major chord with lower note chosen as root note.

(v) 4th: selects major chord with higher note chosen as root note.

(vi) two consecutive notes: selects major chord with higher note chosen as root note.

Three note chords (i) major: selects major chord with lowest note chosen as root note.

(ii) minor: selects minor chord with lowest note chosen as root note.

(iii) 3-note diminished: selects a dominant 7th chord containing the 3 notes with root note chosen as a major third lower than the lowest of the three notes.

(iv) augmented: selects augmented chord with one of the original notes as the root note.

(v) three consecutive notes: selects a major chord with the highest note chosen as the root note.

Four note chords (i) dominant 7th: selects dominant seventh.

(ii) minor 7th, or major 6th: selects a major chord as a major 6th (i.e. if input is C, D#, G, A#, select D# major chord) with root note corresponding to a major 6th chord.

(iii) diminished 7th: selects diminished seventh with one of the original notes as the root note.

(iv) major 7th selects major 7th.

Five note chords (i) 9th chord: selects 7th chord with the same root note.

(ii) major 9th chord: selects major 7th chord with the same root note.

In the preferred embodiment of the invention as previously described, the detection priority was given to the highest actuated notes in the selection of a root note. This priority was implemented by reading data from the note status register 12 in a sequence starting from the highest and continuing to the lowest note in a musical octave. The priority can be reversed by reading out data in a sequence starting from the lowest note. A corresponding change must be made in the correlation logic 7 by inverting the order of the correlation logic shown in FIG. 5.

The action of chord and root note detection subsystem shown in FIG. 3 can also be described in the following fashion using signal theory terminology.

The actuated note input data is stored in the note status register 12. This stored data is converted into a time domain signal by shifting the data out of the note status register 12 to the correlation shift register 11 in response to the RESET signals generated by the scan counter 2. The correlation shift register 11 is a device which acts to provide output data corresponding to the input actuated keyswitch data in a succession of signals in cyclically permutated data order. That is, if the input data set consists of the 12 binary states a1, a2,–, a12; the first cyclically permutated output will be a2, a3,–, a12, a1. The second cyclically permutated output will be a3, a4,–, a12, a1, a2; and so on. These cyclically permutated output signals are generated in response to the RESET signals from the scan counter 2.

A library of matched filters is contained in the correlation logic 7. Each of these matched filters corresponds to a musical chord. The matched filters are used as transfer functions to process the data presented at the output terminals of the correlation shift register 11. For each of the cyclically permutated states of the data in the correlation shift register 11, the output data is processed by a selected matched filter, or transfer function. The processing consists of a bit-by-bit multiplication of each bit of the output data by an associated bit of the matched filter. The matched filter is essentially a binary sequence because it is implemented as a reversed image of the chords in the form of a binary digit sequence.

The output of the transfer function processing is obtained by summing the individual bit-by-bit multiplications. This sum is called the correlation number.

The combination of the correlation counter 8, comparator 10, select gate 25, and chord memory 9 act as a selection means to store the maximum value of the correlation number obtained by a priority implemented by the order in which the matched filters are stored in the correlation logic 7 and accessed by the chord counter 4. The gate 224 in response to the solo priority subsystem, yields a zero value correlation number for any chord that does not contain the highest note keyed on the upper keyboard as an element of the chord. The comparator 10 acts as a decision means in selecting the chord types and root notes.

The detailed logic for the highest note detector 261 is shown in FIG. 4. The upper note status register 203 is a register of 61 bits that contains the actuated keyboard switch status for the first set of contacts on the upper keyboard switches 202. There are 61 keyboard switches in a full keyboard switch array for an organ. The start signal generated from the OR-gate 5 in FIG. 3 is used to set the flip-flop 221. When this flip-flop is set, the RESET signals generated by the scan counter 2 are passed via gate 220 to sequentially address data out of the upper note status register 203. The upper note status register 203 is advantageously implemented as a parallel-load shift register receiving input data from the upper keyboard switches 202. When a logic "1" state is read out of the upper note status register 203, the flip-flop 221 is reset and thereby terminates further reading of data from the upper note status register 203. In this fashion the reading action stops with the output of the upper note status register 203 advanced to the highest note actuated on the upper keyboard switches 202. Data is read out of the upper note status register in a sequence starting with a state corresponding to the highest keyboard note and advancing toward the lowest keyboard note.

The highest note data is inserted into the note status register at the corresponding note position within an octave because of the scan action of the scan counter 2.

The highest note detector 261 comprises the upper note status register 203, gate 220, and flip-flop 221.

The highest note data is also stored in the highest note register 250 at the proper musical note location within an octave determined by the state of the scan counter 2.

The binary state of the chord counter 4 is decoded into six output lines corresponding to the library of stored chord types in the correlation logic 7. States 0 and 1 are decoded onto a single line because both these states correspond to a major chord. The decoded chord counter states are combined with the highest note datum stored in the highest note register by means of the illustrated set of logic gates to provide control signals for gate 224. These gates comprise the logic of the solo priority 205 of FIG. 1. The action of these gates is to provide a "1" logic state signal to the gate 224 if the datum stored in the highest note register 250 is a member, or element, of the current chord type selected by the state of the chord counter 4. If a "0" logic state is sent to gate 224, the state of the correlation counter is not transferred to the comparator 10. Instead a zero value is transferred by gate 224 for the correlation number.

An example will illustrate the action of the logic gates shown in FIG. 1. Assume that the highest upper keyboard note is a G# and a single E has been keyed on the lower keyboard. In this case the note status register 12 will contain a logic state "1" for the note positions of G# and E. The RESET signal from the scan counter 2 causes the data in the highest note register 250 to shift to the right. This register is operated in the usual end-around mode in which output data from one end is written as input data at the other end.

The solo priority 205 operation starts with the chord counter 4 in its lowest count state which produces a logic "1" state on the output line labeled major corresponding to a major chord selection for the correlation logic 7. For the lowest state of the scan counter the output "1" state from the G# position of the highest note register 250 is sent to the AND-gate corresponding to an augmented chord. Thus for this position the output of the OR-gate 223 is a logic "0" state as an input to the gate 224. For each succeeding state of the scan counter 2, the data bit in the highest note register 250 is shifted to the right. Each state will produce a "0" input to the gate 224 until the highest note bit has shifted to a position so that it is one input to an AND-gate which has a major chord decoded line as the second input. This will first occur when the highest note bit has been shifted to the C position in the highest note register. At this time a "1" signal will be sent to the gate 224 and thus an E major chord would be selected. A similar action is implemented for the remainder of the library of chord types.

The solo priority 205 logic operation can also be described in the terminology of signal theory. The set of AND-gates shown in FIG. 4 represent a set of transfer functions called the inhibit transfer functions. The inhibit transfer functions are a set of matched filters each of which corresponds to a musical chord in the library of musical chords. The data in the highest note register 250 is cyclically permutated by the RESET signal from the scan counter 2. The permuted data output is processed in turn by each of the inhibit transfer functions to obtain an inhibit correlation number. In this case the inhibit correlation number is the output of the OR-gate 223 and can have the binary state of "0" or "1". The set of AND-gates acts as a multiplication means and the OR-gate 223 acts as an adder means. The subsystem including gate 224 is called an inhibit correlation means and is used to scale the correlation numbers created in the correlation counter 8.

It is noted that until a keyswitch has been actuated on the upper keyboard switches 202, gate 224 will only transfer a zero value to the comparator 10.

Figure 6:
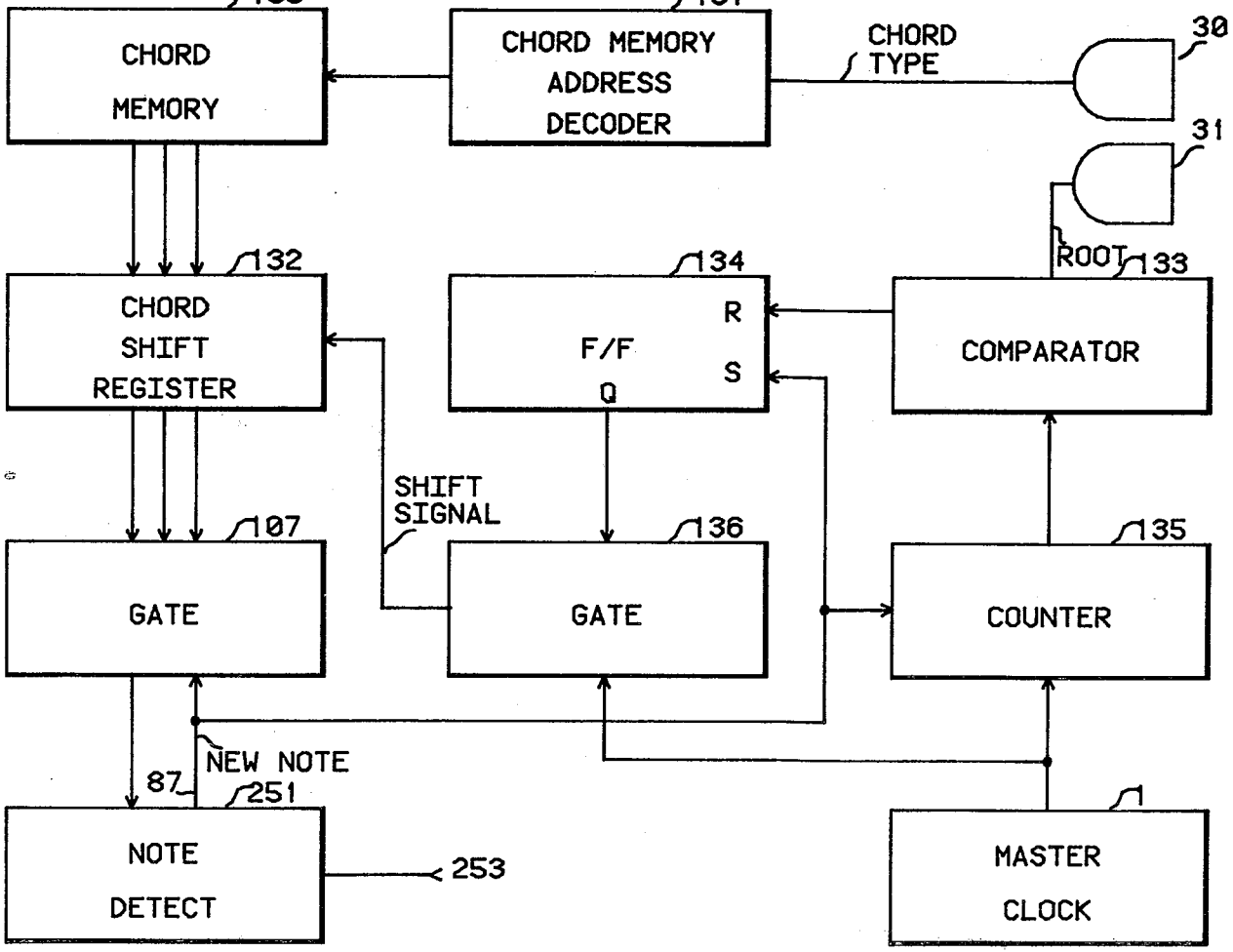
FIG. 6 is a schematic diagram of the transposer logic.

The logic details of the transposer 206, contained in the utilization means 32, are shown in FIG. 6. The purpose of the transposer subsystem is to translate the selected chord contained in the chord memory 9 to upper keyboard keyswitch information and cause the fill-in notes to sound below the highest actuated note on the upper keyboard.

The chord memory 130 can be implemented as a ROM (read only memory) storing the seven binary data words listed in Table 2 for each of the library of chord types. The chord memory address decoder 131 receives the chord type data from the AND-gate 30 and transfers this data to a memory address for accessing a binary word from the chord memory 130.

The chord data in the form of a binary word accessed from the chord memory 130 is transposed to correspond to the selected root note by means of the chord shift register 132. This shift register is parallel loaded with data read out from the chord memory 130 and is operated in the conventional shift register end-around mode of operation. The data loaded in the chord shift register 132 is shifted in an end-around mode by a number of bit positions equal to one less than the root note expressed as a note number in the musical octave. The numbering convention is that the musical note C is given the note number 1 and the musical note B is given the note number 12. After the shifting operation, the data residing in the chord shift register 132 is called the transposed data set.

Note detect 251 is used to detect changes in the switch states of the upper and lower array of keyboard switches contained in lower keyboard switches 201 and upper keyboard switches 202. Note detect 251 furnishes the commands to the upper generator assignor 208 and the lower generator assignor 271 for controlling the associated tone generators. A description of a note detect and assignor system is disclosed in U.S. Pat. No. 4,002,098 entitled "Keyboard Switch Detect And Assignor." This patent is hereby incorporated by reference.

When the note detect 251 determines that a new note has been actuated on the upper keyboard, a NEW NOTE signal is generated on line 87. The NEW NOTE signal sets the flip-flop 134 and resets the counter 135 to its initial count state. When flip-flop 134 is set, a "1" logic state signal is transmitted to the gate 136. In response to an input "1" logic state, gate 136 transfers timing signals from the master clock 1 to shift the data stored in the chord shift register 132.

Flip-flop 134 is reset when the comparator 133 detects that the state of the counter 135 is one less than the numerical value of the root note as transmitted by AND-gate 31.

Since the master clock 1 is advantageously operated at a 1 Mhz rate, the maximum time expended for the chord transpose operation is 12 microseconds. This time interval is essentially equivalent to an instantaneous response for a musical tone generation system.

When the flip-flop 134 is reset, the chord shift register 132 contains the fill-in note data which has been transposed with respect to the root note. This transposed data set should be transposed to the octave below the highest note before being used to assign members of the upper tone generators 209. The octave information is obtained by means of the octave counter 253 shown in FIG. 4. Octave counter 253 is reset to its highest count of six when the START signal is generated. The octave counter is implemented as a down-counter which is decremented by the RESET signals transferred by the gate 220. In this fashion the state of the octave counter 253, at the time that the highest note has been detected, is one less than the octave in which the highest note has been played.

Figure 7:
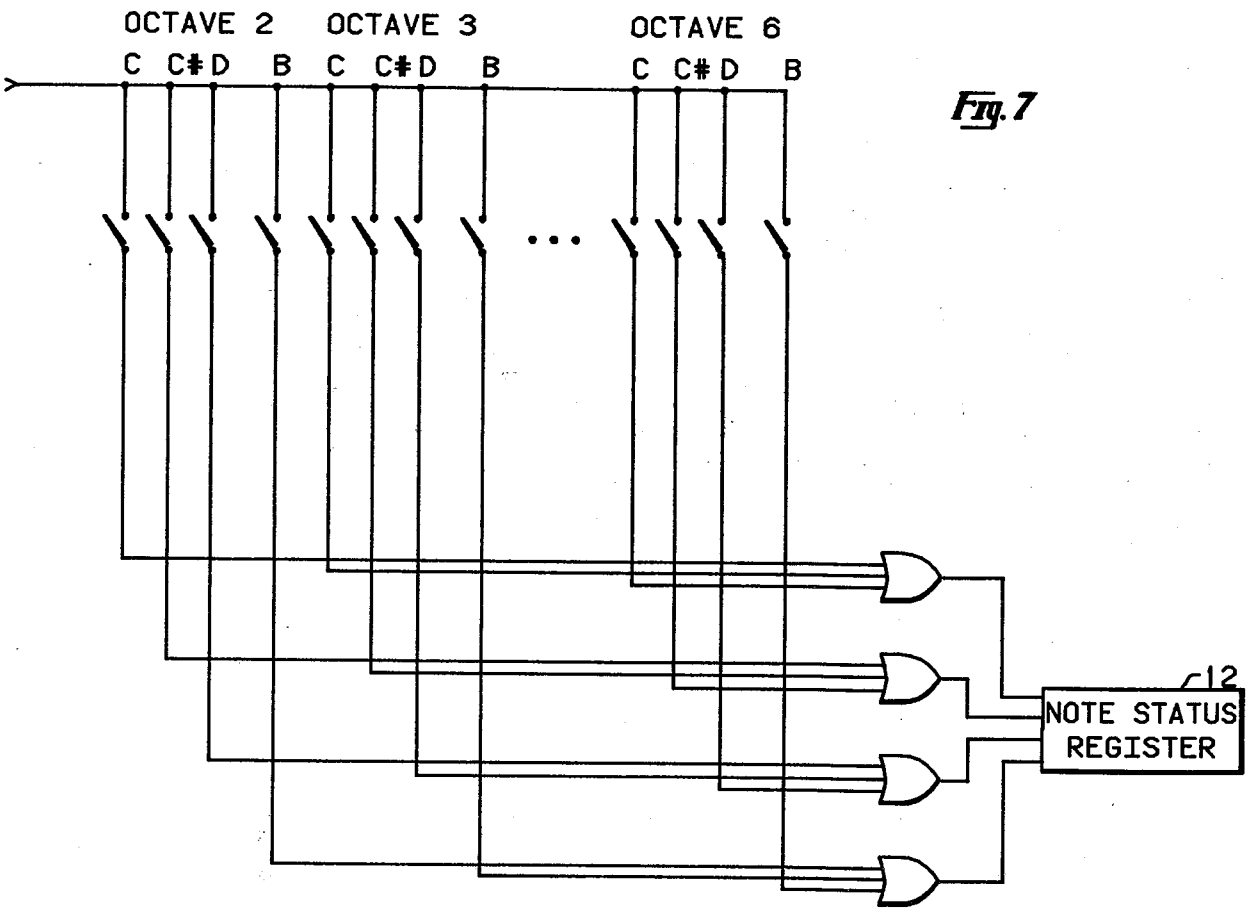
FIG. 7 is a schematic diagram of the upper generator assignor 208.

FIG. 7 illustrates the logic comprising the upper assignor 208 which contains the subsystems for a fill-in note assignor. The gate 107 of FIG. 6 is explicitly shown as the set of 12 AND-gates 107*a* through 107*l*. Each AND-gate is connected to a corresponding output terminal of the chord shift register 132. The output of each of the AND-gates is connected to a corresponding element of the set of 12 OR-gates labeled 338*a* through 338*l*. These OR-gates are the same as the OR-gates 28*a* through 281 shown in FIG. 1 of the referenced U.S. Pat. No. 4,002,098. Each of these OR-gates corresponds to one of the notes of a musical octave as described in the patent.

The division counter 363 of FIG. 7 is the same as the division counter 63 shown in FIG. 2 of the referenced patent. The group counter 357 of FIG. 7 is the same as the group counter 57 shown in FIG. 2 of the referenced patent. A logic "1" state on line 42 from the division counter 363 is generated when the switch states of the upper keyboard are scanned to determine the keyswitch states. A logic "1" state on line 43 occurs when the lower keyboard keyswitches are scanned.

The states of the group counter 357 correspond to the musical octaves for the keyboards. Comparator 254 furnishes a logic "1" signal when the group counter 357 has been incremented to equal the count state of the octave counter 253. This will occur when the group counter has been incremented to one octave less than the octave in which the highest note has been played. In this fashion the transposed chord data residing in the chord shift register is inserted into the note detect and assignor system for the proper keyboard and octave each time a NEW NOTE signal is generated.

A system similar to that shown in FIG. 7 can be used to implement the low generator assignor 271 shown in FIG. 1. In this case the line 43 would be used to activate the data select gates so that the data inserted into the note detect and assignor system would be assigned to the lower keyboard tone generators.

Various musical effects can be obtained by controlling the nature of the NEW NOTE signal. For example an AND-gate could be inserted in line 87 so that the NEW NOTE signal can be controlled rhythmically by connecting a rhythm generator as one of the signal inputs to the AND-gate. Another alternative is to connect a signal from the ADSR generator for the highest note to this AND-gate. In this fashion the fill-notes will be sounded in the same rhythmic pattern as the highest note and will not be keyed by any other notes that might be played on the upper keyboard.

We claim:

1. In a keyboard instrument having a first and second keyboard array of keyswitches, apparatus for adding fill-in notes to notes played on the first keyboard comprising:

a first detection means for detecting actuated keyswitches in said first keyboard array of keyswitches, a second detection means for detecting actuated keyswitches in said second keyboard array of keyswitches, a first plurality of tone generators for creating musical tones, a second plurality of tone generators for creating musical tones, a chord detect means responsive to a combination of actuated keyswitches detected by said first detection means and by actuated keyswitches detected by said second detection means comprising a matched filter processor wherein a musical chord type is selected from a preselected multiplicity of musical chord types irrespectively of whether or not said combination of said actuated keyswitches comprise one of said musical chord types, a root note generator means responsive to actuated keyswitches detected by said first detector means and by actuated keyswitches detected by said second detection means whereby a chord root note number is generated, a first assignor means for assigning tone generators in said first plurality of tone generators to actuated keyswitches detected by said first detection means and for assigning tone generators in said first plurality of tone generators to said musical chord type selected by said chord detect means and transposed by said chord root number thereby providing said fill-in notes, and a second assignor means for assigning tone generators in said second plurality of tone generators to actuated keyswitches detected by said second detection means.

2. In a musical instrument having a first and second keyboard array of keyswitches, apparatus for adding fill-in notes to notes played on the first keyboard comprising:

a first detector means for detecting actuated keyswitches in said first keyboard array of keyswitches.

a second detection means for detecting actuated keyswitches in said second array of keyswitches, a first plurality of tone generators for creating musical tones, a second plurality of tone generators for creating musical tones, a clock providing a sequence of timing signals, a first note encoding means wherein a note number signal is generated corresponding to each actuated keyswitch detected by said first detection means, a second note encoding means wherein a note number signal is generated corresponding to each actuated keyswitch detected by second detection means, a status memory means for storing note number signals generated by said first note encoding means and generated by said second note encoding means, a first memory means for storing data to be thereafter read out, a transfer means whereby data is read from said status memory and stored in said first memory means, a second memory means storing a plurality of transfer functions each of which corresponds to a musical chord type, a first correlation means responsive to selected members of said plurality of transfer functions and responsive to data read out of said first memory means wherein a plurality of correlation numbers are generated, a third memory means wherein a correlation number is stored to be thereafter read out, a comparison means for comparing the magnitude of said plurality of correlation numbers with the correlation number stored in said third memory means wherein a correlation number having the maximum value is selected and stored in said third memory means, a selection means responsive to said timing signals and responsive to the correlation number stored in said third memory means wherein a selection is made of a musical chord type from a preselected multiplicity of musical chord types, a root note generator means responsive to actuated keyswitches detected by said first detection means and responsive to actuated keyswitches detected by said second detection means whereby a chord number is generated, a first assignor means for assigning tone generators in said first plurality of tone generators to actuated keyswitches detected by said first detection means and for assigning tone generators in said first plurality of tone generators to said musical chord type selected by said chord detect means and transposed by said chord root number thereby providing said fill-in notes, and a second assignor means for assigning tone generators in said second plurality of tone generators to actuated keyswitches detected by said second detection means.

3. Apparatus according to claim 2 wherein said first note encoding means comprises a highest note selection means whereby the maximum value of said note number signals is selected.

4. Apparatus according to claim 3 wherein said status memory means comprises highest note selection circuitry whereby the maximum value of said note number signals is stored in the status memory means and all other note number signals generated by said first coding means are not stored in the status memory means.

5. Apparatus according to claim 4 wherein said correlation means comprises:

an inhibit correlation means responsive to selected members of said plurality of transfer functions and said maximum value of said note number signals whereby an inhibit correlation number is generated, and inhibit means responsive to said inhibit correlation number whereby said plurality of correlation numbers are generated with a zero numerical value if said inhibit correlation number has a zero value.

6. Apparatus according to claim 5 wherein said clock comprises:

a master clock for generating a sequence of timing signals, a scan counter incremented by said sequence of timing signals wherein said scan counter counts modulo the number of data words stored in said status memory and wherein a reset signal is created when the scan counter is reset at its maximum count state, a shift counter incremented by said reset signals wherein said shift counter counts modulo the number of data words stored in said status memory and wherein a shift reset signal is created when the shift counter is reset at its maximum count state, and a chord counter incremented by said reset signals wherein said chord counter counts modulo the number of said plurality of transfer functions and wherein a chord reset signal is created when the chord counter is reset at its maximum count state.

7. Apparatus according to claim 6 wherein said transfer means comprises:

coincidence circuitry wherein a start signal is generated in response to a simultaneous occurence of said reset signal, said shift reset signal and said chord reset signal, and memory addressing means responsive to said start signal whereby data is addressed out from said status memory means each time said reset signal is created by said scan counter.

8. Apparatus according to claim 7 wherein said memory addressing means further comprises:

a memory access logic means responsive to the count state of said chord counter whereby data addressed out from said status memory means is stored in said first memory means when said count state returns to its minimum value, and a memory address decoding means responsive to said reset signals whereby data is accessed from said first memory means in a cyclic permutation order.

9. Apparatus according to claim 8 wherein said correlation means comprises:

a function select means for reading out a transfer function from said second memory means in response to each state of said chord counter, a multiplication means wherein data accessed from said first memory means is multiplied by the transfer function read out by said function select means thereby generating a plurality of product values, and an adder means wherein said plurality of product values are summed to generate a correlation number.

10. Apparatus according to claim 9 wherein said comparison means comprises:

a comparison selection means wherein the correlation number generated by said adder means is compared with the correlation number stored in said third memory means and wherein the correlation number having the largest magnitude is stored in said third memory means, and a selection signal generator means wherein a selection signal is generated when said comparison selection means selects a new value for the highest value correlation number.

11. Apparatus according to claim 10 wherein said selection means comprises:

a chord type memory means for storing data to thereafter read out, and a selection memory address means responsive to said selection signal whereby the count state of said chord counter is stored in said chord type memory means.

12. Apparatus according to claim 10 wherein said root note generator means comprises:

a root note memory means for storing data to be thereafter read out, and a root note selection memory address means responsive to said selection signal whereby the count state of said shift counter is stored in said root note memory means.

13. Apparatus according to claim 2 wherein said second memory means comprises:

an addressable memory storing a plurality of data words wherein each data word comprises a binary number having bit values for a matched filter for said corresponding musical chord type.

14. Apparatus according to claim 5 wherein said inhibit correlation means comprises:

a highest note memory means for storing the maximum value of said note number signals, a second memory address decoding means responsive to said reset signals whereby data is accessed from said highest note memory means in a cyclic permutation order, a fourth memory means storing a plurality of inhibit transfer functions each of which corresponds to a musical chord type, an inhibit function select means for reading out an inhibit transfer function from said fourth memory means in response to each state of said chord counter, an inhibit multiplication means wherein data accessed from highest note memory means is multiplied by the inhibit transfer function read out by said inhibit function select means thereby generating a plurality of inhibit product values, and an inhibit adder means wherein said plurality of inhibit product values are summed to generate said inhibit correlation number.

15. Apparatus according to claim 12 wherein said first assignor means comprises:

a chord memory means storing a plurality of chord data sets each of which corresponds to a musical chord type, a chord memory select means responsive to the chord type selected by said chord detect means for reading out a chord data set from said chord memory means, and chord transposition means responsive to said selected chord root number whereby said chord data set read out from said chord memory means is cyclically permutated to form a transposed chord data set.

16. Apparatus according to claim 15 wherein said first note coding means further comprises:

an octave counter means incremented by said reset signals created by said scan counter, and an octave gate interposed between said scan counter and said octabe counter means whereby said reset signals are transferred to the octave counter when said start signal is generated and whereby said reset signals are not transferred to the octave counter when said maximum value of said note number signals is selected by said first note coding means.

17. Apparatus according to claim 16 wherein said first assignor means comprises:

a fill-in note assignor means whereby tone generators in said first plurality of tone generators are assigned in response to said transposed chord data set and in response to the count state of said octave counter.

18. A musical instrument having a first and second keyboard array of keyswitches and having a first plurality of tone generators assigned to the first keyboard and a second plurality of tone generators assigned to the second keyboard, apparatus for adding fill-in notes to notes played on the first keyboard comprising:

a master clock means for generating a sequence of timing signals and for generating a start signal corresponding to an initial timing signal, a note encoding means whereby note numbers are assigned to actuated keyswitches on said first and second keyboard arrays of keyswitches, a highest note detector for selecting the highest valued note number from the note numbers corresponding to actuated keyswitches on said first keyboard array of keyswitches, a status memory for storing said highest valued note number and the note numbers assigned to actuated keyswitches on said second keyboard array of keyswitches, a correlation memory means for storing data to be thereafter read out, a transfer means responsive to said start signal whereby data is read out of said status memory and stored in said correlation memory means, a first transfer function memory means storing a plurality of first matched filters each of which corresponds to a preselected musical chord type, a second transfer function memory means storing a plurality of second matched filters each of which corresponds to a preselected musical chord type, a first memory addressing means responsive to said sequence of timing signals whereby each of said first matched filters is selected consecutively from said first transfer function memory means, a second memory addressing means responsive to said sequence of timing signals whereby each of said second matched filters is selected consecutively from said second transfer function memory means, a first matched filter processor means wherein data stored in said correlation memory means is processed by each of said selected first matched filters thereby generating a plurality of first correlation numbers each of which corresponds to one of said selected first matched filters, a second matched filter processor means wherein said highest valued note number is processed by each of said selected second matched filter thereby generating a plurality of second correlation numbers, a correlation multiplication means whereby each of said plurality of first correlation numbers is multiplied by a corresponding one of said plurality of second correlation numbers thereby producing a plurality of scaled correlation numbers, a decision means responsive to said plurality of scaled correlation numbers wherein a selection is made of a first matched filter corresponding to the maximum of said scaled correlation numbers, and a utilization means responsive to said selection of a first matched filter by said decision means whereby tone generators in said first plurality of tone generators are assigned thereby producing said fill-in notes.

19. Apparatus according to claim 18 wherein said decision means comprises:

priority assignment means wherein said first matched filters are assigned priority values, and priority selection means responsive to said priority values whereby if a multiplicity of said scaled correlation numbers have equal values said selection is made of the corresponding first matched filter having the largest of said assigned priority values.

* * * * *